US005122006A

United States Patent [19]

MacMillan

[11] Patent Number: 5,122,006

[45] Date of Patent: Jun. 16, 1992

[54] TROWELLING BAR ARCHING ADJUSTMENT APPARATUS

[76] Inventor: Donald M. MacMillan, 45381 McIntosh Dr., Chilliwack, B.C., Canada

[21] Appl. No.: 694,553

[22] Filed: May 2, 1991

[51] Int. Cl.[5] ..... B28B 3/00; B29C 3/04

[52] U.S. Cl. ..... 401/5; 401/48; 425/87; 425/458; 15/235.8

[58] Field of Search ..... 401/5, 48; 425/87, 458, 425/375; 15/235.8

[56] References Cited

U.S. PATENT DOCUMENTS

| | | | |
|---|---|---|---|
| 2,666,323 | 1/1954 | Ames | 401/48 X |
| 2,824,442 | 2/1958 | Ames | 401/48 X |
| 2,984,857 | 5/1961 | Ames | 401/5 X |
| 3,163,881 | 1/1965 | Apecella | 401/5 X |
| 3,186,056 | 6/1965 | Hoveland | 401/5 X |
| 3,912,402 | 10/1975 | English | 401/48 X |
| 4,129,407 | 12/1978 | Golls et al. | 15/235.8 X |
| 4,516,868 | 5/1985 | Molnar | 401/5 |

*Primary Examiner*—Danton D. DeMille
*Attorney, Agent, or Firm*—Robert W. Jenny

[57] ABSTRACT

The apparatus adjusts the arching of the trowelling bar used in the heads of flat finishing boxes. The trowelling bar and the guide strip in which it is mounted form an assembly which, for use with the subject apparatus, is straight in its free state. The apparatus comprises two plungers which are attached with some angular freedom to the guide strip at its quarter points, i.e. the two points essentially midway between its center and each of its ends. When the plungers are moved upward the guide strip/trowelling bar assembly is arched upward. When the plungers move downward the assembly is arched downward. The plunger motions are caused and controlled by two leaf springs, the first disposed to move the plungers upward, the second downward. The influence of one spring is adjusted by a cam which is adjustable so that: (1) the influence of the springs are equal and the assembly is straight; (2) the influence of the first spring prevails by various amounts to produce varied upward arching of the assembly and (3) the influence of the second spring prevails by various amounts to produce varied downward arching of the assembly. In an alternate embodiment one leaf spring is replaced by two helical compression springs which serve the same purpose.

3 Claims, 1 Drawing Sheet

FIG. 1
PRIOR ART
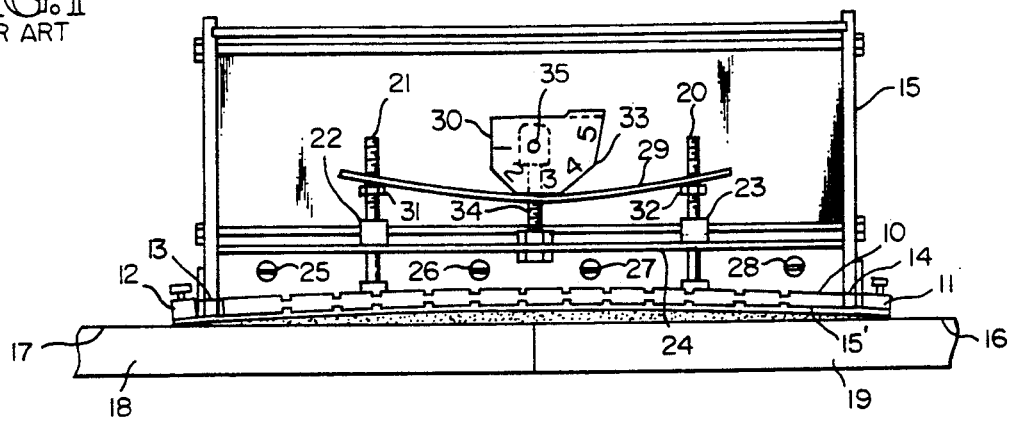
FIG. 2
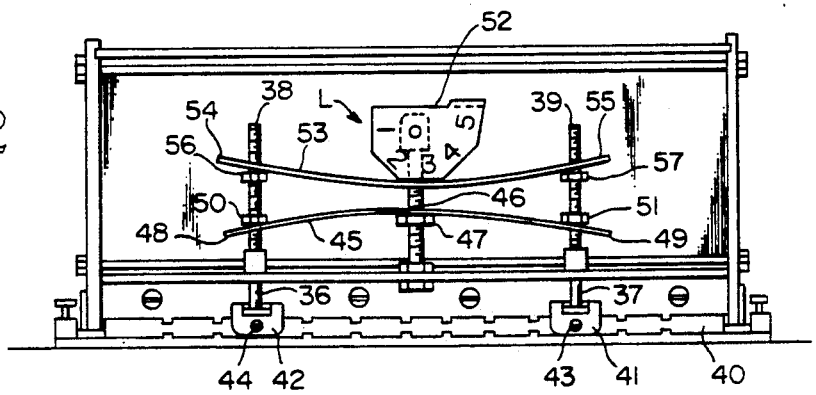
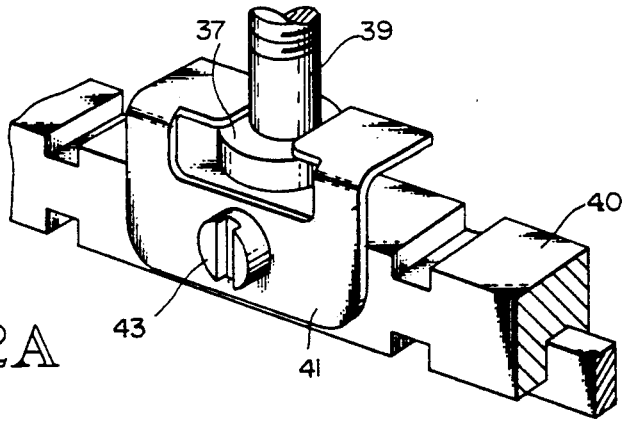
FIG. 2A
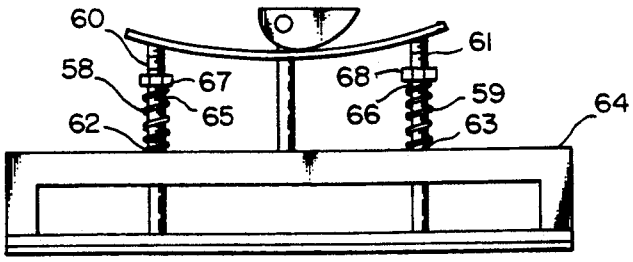
FIG. 3

TROWELLING BAR ARCHING ADJUSTMENT APPARATUS

BACKGROUND OF THE INVENTION

1. Field

The subject invention is in the general field of tools and implements used in the manufacture and construction of buildings. More specifically it is in the field of implements used in the installation of dry walls in such buildings. Still more specifically it is in the field of flat finishing boxes, particularly the heads used on flat finishing boxes. The heads incorporate a flexible blade, often termed the edge or the trowelling bar of the head, and the edge is adjustable to contour the mastic (mud) distributed from the head in a contour ranging from convex (i.e. arced away from the plane of the drywall panels) to flat to concave (i.e. arced into the plane of the drywall panels). The subject invention involves the edge and the edge adjustment mechanism.

2. Prior Art

The closest known prior art to the subject invention is shown in U.S. Pat. Nos. 2,984,857 (Ames) and 4,516,818 (Molnar). In the major embodiment of the Ames apparatus the trowelling bar of the head of the mastic applicator (flat finishing head) is held in a flexible guide strip. The guide strip is held at its ends so that is may be adjustably arched to arch the trowelling bar to influence the curvature of the surface of the mastic (mud) distributed from the box. The apparatus described thus far is common to the subject invention and the two noted prior art concepts. Ames' invention lies in his apparatus for adjusting the amount and direction (i.e. upward or downward) arching of the guide strip and with it the trowelling bar. In the Ames adjustment apparatus the guide bar is arched in its free state and the adjustment apparatus forces it to decrease the arch. The Ames adjustment apparatus contacts the guide bar at the two locations essentially midway between its center and its ends. This is an advantage of the Ames apparatus because it enables adjusting the bar to be essentially straight to produce a flat surface on the dispensed mud. A disadvantage of the Ames apparatus is that the guide strip must be carefully, precisely arched during manufacture and this is known to be difficult to do.

The Molnar apparatus has the advantage of using a guide strip which is straight in its free state and therefore less expensive to manufacture with more predictable use results. However, the Molnar guide strip is connected to the guide strip adjustment apparatus at the center point of the strip. This is a disadvantage in that when the strip and bar are adjusted to be arched the arch is not an arc but is, instead, two arcs and this is not an optimum result.

Accordingly, the object of the subject invention is to provide adjustment mechanism for arching the guide strip and trowelling bar which has the stated advantages of the Ames and Molnar applications and does not have their stated disadvantages. In other words, the objective is to provide an adjustment mechanism which functions with a guide strip which is straight in its free state and contacts the guide strip at two points essentially midway between its center and its ends, i.e. at its quarter points.

SUMMARY OF THE INVENTION

The subject invention is a mechanism for adjusting the arching of the guide strip/trowelling bar assembly used on the heads attached to flat finishing boxes. As is well known in the art, such boxes are used to distribute a mastic, termed mud in the trade, along the junctures of drywall panels. The head for such a box comprises an opening through which the mud is dispensed and, close to the opening, a trowelling bar which distributes and shapes the mud into a swath covering the juncture. It also comprises mechanism for adjusting the guide strip/trowelling bar assembly. The assembly extends across the rear end of the box so that it moves over the dispensed mud as the box is moved forward. It is adjustable such that the surface of the swath may range from being arced out from the plane of the drywall panels to coplanar with the panels to arced inward of the plane of the panels. The guide strip of the assembly is supported at its ends and guided by fixed structure of the head and is below the fixed structure. Two plungers are slidably mounted in the fixed structure at right angles to the long dimensions of the guide strip and fixed structure and located such that the lower ends of the plungers are connected, with some angular freedom, to the quarter points of the guide strip. The upper ends of the plungers are attached, with some angular freedom, to the ends of a leaf spring which extends from one plunger to the other. There is a hole at the center of the spring so that the spring slides on a shaft. The longitudinal axes of the shaft and plungers are parallel and the shaft is fixed at its lower end to the fixed structure which supports and guides the guide strip. A spiral shaped cam is pivoted to the upper end of the shaft and sized and shaped such that at one extreme of its motion it contacts the lengthwise center of the spring with the lowest force in the range of force applied to the spring by the cam and the force increases as the cam is moved and reaches a maximum at the other extreme of the cam's motion. The force applied by the cam tends to push the plungers against the guide bar and arch it downward; i.e. so that it would arc into the plane of the panels.

A second leaf spring is slidably mounted on the shaft approximately midway between the first spring and the fixed structure and its ends also engage the plungers with some angular freedom. Whereas the first spring, acting through the plungers, tends to arc the guide strip downward, the second spring tends to arc it upward. The cam and spring system is so designed and adjusted that when the cam is set at its medium setting midway between its extremes of motion, the first and second springs have equal influence and the guide strip remains straight.

When the cam is adjusted to increase the downward deflection of the first spring the force applied to the plungers by the first spring overcomes the force applied to the plungers by the second spring and the plungers move to arch the guide strip downward. Conversely, when the cam is moved to reduce the deflection of the first spring and the force it applies to the plungers, the second spring forces the plungers upward, resulting in upward arching of the guide strip. It will be understood that the trowelling box is arched with the guide strip. In a second embodiment of the invention the second spring is replaced by two compression springs, one on each plunger between the fixed structure and engagement means on each plunger.

It can be understood at this point that the guide strip/trowelling bar assembly is made and installed straight and can be arched as needed by forces applied at its quarter points, thus producing essentially pure arc shapes when the assembly is not straight. The invention is described in more detail below, with reference to the attached drawings.

BRIEF DESCRIPTION OF THE DRAWINGS

FIG. 1 is a reproduction of FIG. 4 in U.S. Pat. No. 2,984,857 to Ames and is a rear view of a flat finishing box showing the mechanism for adjusting the arching of the guide strip/trowelling bar assembly.

FIG. 2 is similar to FIG. 1 but modified to show the subject invention.

FIG. 2A is an enlarged view of a portion of the mechanism.

FIG. 3 is a schematic representation of an alternate embodiment of the subject invention.

DETAILED DESCRIPTION OF THE INVENTION

The subject invention is apparatus for adjusting the arching of the guide strip/trowelling bar assembly of the head assembly for a flat finishing box. A well known prior art example of such apparatus is shown in FIG. 1. Guide strip 10 is attached with some angular freedom at its ends 11 and 12 to points 13 and 14 of flat finishing box 15. Trowelling bar 15' is imbedded in a slot in the guide strip. The guide strip/trowelling bar assembly is, in effect, a spring arched away from the plan of surfaces 16 and 17 of drywall panels 18 and 19. The assembly is made with a higher arch than illustrated and is held as shown by forces applied by plungers 20 and 21 and slidably mounted in bushings 22 and 23 attached to structure 24 fixed to the box 15 by screws 25, 26, 27 and 28. Structure 24 is hereinafter referred to as fixed structure. The forces applied by the plungers are produced by the deflection of flat spring 29 by cam 30 and applied to the nuts 31 and 32 on the plungers and thence to the plungers. For purposes of this disclosure the engagement of the spring with the nuts on the plungers constitutes attachment of the spring ends to the plungers with some angular freedom.

Surface 33 on cam 30 is a spiral which is flatted to produce detenting action to hold the cam set in several settings from one extreme of its adjustment motion to the other. The cam is pivoted to shaft 34 at 35 and the shaft is attached at its lower end to the fixed structure. The shaft is midway between the plungers and the longitudinal axes of the plungers and shaft are parallel and coplanar. When the cam is rotated clockwise in this view it interacts with the spring to deflect the spring more, increasing the forces on the plungers and the guide strip to flatten the arch of the assembly. At the extreme clockwise setting of the cam the guide strip may be arched downward; i.e. into the plane of surfaces 16 and 17. The apparatus is adjusted by adjusting the nuts on the plungers so that at an intermediate (medium) setting the guide strip/trowelling bar assembly is essentially straight.

FIG. 2 illustrates the apparatus of FIG. 1 modified to incorporate the subject invention. The modifications are as follows: Ends 36 and 37 of plungers 38 and 39 are attached to guide strip 40 by clips 41 and 42, the attachment allowing some angular freedom. The clips are attached to the guide strip by fasteners 43 and 44. The attachment is shown enlarged in FIG. 2A with parts numbered as in FIG. 2. A second leaf spring 45 is installed on shaft 46 and against nut 47 threaded onto the shaft. Ends 48 and 49 of this second spring engage nuts 50 and 51 and thereby engage plungers 38 and 39. Nuts 50 and 51 are adjusted to adjust the forces applied by spring 45 to the plungers. As in the apparatus of FIG. 1, cam 52 interacts with spring 53, pressing downward in the center of it so that ends 54 and 55 put downward pressure on nuts 56 and 57 on the plungers. Nut 47 is adjusted on the shaft to put upward pressure on spring 45. With the cam in a medium setting as shown, nut 47 is adjusted so that the upward forces applied to the plungers by spring 45 equals the downward forces applied to the plungers by spring 53. The result is that with this setting of the cam the plungers apply no forces to the guide strip and the guide strip/trowelling bar assembly remains in its free state; i.e. straight. When the cam is rotated counterclockwise in this view the deflection and forces applied by spring 53 diminish and the forces applied by spring 45 raise the plungers which deflect the guide strip/trowelling bar assembly into an upward arch. Conversely, when the cam is rotated clockwise in this view the deflection of and forces applied by spring 53 increase, overcoming the forces applied by spring 45 and causing the assembly to be arched downward. The amounts of arching depend on cam settings.

FIG. 2A is an enlarged view of the connection of plunger 39 to guide strip 40 with parts numbered as in FIG. 2.

Since the guide strip/trowelling bar assembly is resilient, the apparatus is a system of interconnected and interacting springs with the balance of interactive forces influenced by the setting of the cam.

FIG. 3 illustrates schematically an alternate embodiment of the invention in which the second leaf spring is replaced by two helical compression springs. Springs 58 and 59 are installed on plungers 60 and 61. Their lower ends 62 and 63 contact fixed structure 64 and their upper ends 65 and 66 contact nuts 67 and 68 threaded onto the plungers. Adjustment of these nuts adjusts the forces applied to the plungers by the springs. It is considered understandable that the compression springs serve the same purposes as spring 45 in the embodiment shown in FIG. 2.

It is also considered to be understandable from this description that the subject invention meets its objectives. It provides trowelling bar arching adjustments apparatus which contacts the guide strip/trowelling bar assembly at its quarter points and functioning with a guide strip/trowelling bar assembly which is straight in its free state. The apparatus thus has the above stated advantages of the apparatuses of Molnar and Ames and avoids the above stated disadvantages of those apparatuses.

It is further considered to be understood that while certain embodiments of the invention are described herein, other embodiments and modification of those described are possible within the scope of the invention which is limited only by the attached claims.

I claim:

1. Apparatus for adjusting the arching of a trowelling bar installed on the head attached to a flat finishing box, said head having fixed structure, said trowelling bar being installed in guide strip, said guide strip having first and second quaterpoints are being attached to said fixed structure, said trowelling bar and said guide strip forming an assembly archable through a range from arched downward to straight to arched upward, said apparatus comprising:

first and second plungers, each having first and second ends and being movably mounted in said fixed structure, said first ends of said plungers being attached with angular freedom to said guide strip, one at said first quarter point, the other at said second quarterpoint, first spring means engaging said first and second plungers having first influence on said plungers and assembly to move said plungers downward and arch said assembly downward, second spring means engaging said first and second plungers and having second influence on said plungers and assembly to move said plungers upward and arch said assembly upward, means for adjusting said first spring means to adjust said first influence in the range of greater than, equal to and less than said second ifluence, whereby when said first influence is greater than said second influence said assembly is arched downward, when said first influence is equal to said second influence said assembly is straight and when said first influence is less than said second influence said assembly is arched upward.

2. Apparatus for adjusting the arching of a guide strip/trowelling bar assembly used on a head of a flat finishing box, said head comprising fixed structure, said assembly having first and second ends and a center, said ends being attached with angular freedom to said fixed structure, said apparatus being attached with angular freedom to said assembly at first and second points, said first point being essentially midway between said first end and said center, said second point being essentially midway between said second end and said center, said apparatus comprising:

first and second plungers, each haing a longitudinal axis and first and second ends, a shaft having a longitudinal axis, first and scond ends and being threaded, a nut, said nut being installed on said shaft, a cam, a first leaf spring having a center and first and second ends and a second leaf spring having a center and first and second ends, said first plunger being attached with angular freedom to said first point, said second plunger being attached with angular freedom to said second point, said first end of said shaft being attached to said fixed structure and said plungers being slidably mounted in said fixed structure such that said longitudinal axes of said plungers and said longitudinal axis of said shaft are all parallel to each other and said shaft is midway between said plungers, said cam being pivotally mounted at said second end of said shaft and adjustable through a range of settings from a first extreme to a medium setting to a second extreme, said first leaf spring having a hole at said center of said first leaf spring and being slidably installed on said shaft with said shaft through said hole and said first end of said first spring being attached with angular freedom to said first plunger and said second end of said first spring being attached with angular freedom to said second plunger, said cam interacting with said first spring such that adjusting said cam through said range of settings deflects said first spring in varying amounts to cause said first spring to apply adjustable amounts of force to each of said first and second plungers in a first direction, said second leaf spring having a hole at said center of said second leaf spring and being installed on said shaft adjacent to said nut on said shaft with said shaft through said hole at said center of said second leaf spring and said first end of said second spring engaging said first plunger with angular freedom and said second end of said second spring engaging said second plunger with angular freedom such that adjustment of said nut on said shaft adjustably deflects said second spring to cause said second spring to apply adjustable amounts of force to each of said first and second plungers in a second direction, whereby with said cam adjusted at said medium setting said nut on said shaft can be adjusted such that said forces in said second dirction on said plungers in said first direction so that said plungers thereby transmit no force to said assembly, and further whereby when said cam is adjusted toward said first extreme said forces applied by said first spring to said plungers diminish and said forces applied by said second spring to said plungers move said plungers in said second direction and said plungers arch said assembly in said second direction, and further whereby when said cam is adjusted toward said second extreme said forces applied by said first spring to said plungers increase and move said plungers in said first direction and said plungers arch said assembly in said first direction.

3. The apparatus of claim 1 in which said second spring means comprises first and second helical compression springs, each having first and second ends, said first compression spring being installed on said first plunger with said first end of said first compression spring against said fixed structure and said second end of said first compression spring engaging first means for engagement of said first compression spring and said first plunger such that it applied force to said first plunger in said second direction, said first means for engagment being adjustable to adjust the forces applied by said first compression spring to said first plunger and said second compression spring being installed on said second plunger with said first end of said second compression spring against said fixed structure and said second end of said second compression spring engaging second means for engagement of said second compression spring and said second plunger such that it applies force to said second plunger in said second direction, said second means for engagement of being adjustable to adjust the forces applied by said second compression spring to said second plunger.

* * * * *